US007390239B1

(12) United States Patent
Huang

(10) Patent No.: US 7,390,239 B1
(45) Date of Patent: Jun. 24, 2008

(54) THREE-DIMENSION BRA CUP SUPPORT STRUCTURE

(76) Inventor: Huei-Rong Huang, No. 29, Lane 187, Cyong Lin S. Road, SinJhuang City, Taipei County (TW)

( * ) Notice: Subject to any disclaimer, the term of this patent is extended or adjusted under 35 U.S.C. 154(b) by 0 days.

(21) Appl. No.: 11/627,448

(22) Filed: Jan. 26, 2007

(51) Int. Cl.
*A41C 3/00* (2006.01)
*A41C 3/10* (2006.01)

(52) U.S. Cl. ..... 450/39; 450/92; 450/93

(58) Field of Classification Search ..... 450/39–57, 450/92, 93
See application file for complete search history.

(56) References Cited

U.S. PATENT DOCUMENTS 3,101,717 A * 8/1963 Korman ..... 450/39
3,266,495 A * 8/1966 Sachs ..... 450/55
5,472,366 A 12/1995 Moore
6,106,363 A 8/2000 Werner
6,837,771 B2 * 1/2005 Falla ..... 450/39
7,131,888 B2 * 11/2006 Hsu ..... 450/39

* cited by examiner

*Primary Examiner*—Gloria Hale
(74) *Attorney, Agent, or Firm*—Rabin & Berdo, P.C.

(57) ABSTRACT

The present invention is to provide a three-dimension bra cup support structure comprising at least two fabric layers, at least two nonwoven layers and at least one foam layer. The layers are sandwiched with gel and thermal-pressing to constitute the support structure. The bra cup support structure is flexible and subsidiary closed to the lower periphery of the breast to provide a comfort support structure to users.

4 Claims, 6 Drawing Sheets

THREE-DIMENSION BRA CUP SUPPORT STRUCTURE

FIELD OF THE INVENTION

The invention is related to bra cup support structure, and more particularly, to an improved three-dimension bra cup support structure.

BACKGROUND OF THE INVENTION

Devices or elements provided to support and shape the lower periphery of the bra cups have long been known in the art. Such devices or elements have come to be commonly known as "underwires". Over the past years, the underwires have taken many shapes and have been made of many different materials. Commonly, the underwires have been inserted into a fabric sleeves disposed at the lower periphery of the bra cups. U.S. Pat. No. 5,472,366 describes a flexible bra cup support that takes the form of an arcuate length of polymeric or similar materials having a circular cross-sectional shape to fit within the undercup sleeves. The patent to Werner, U.S. Pat. No. 6,106,363 describes a brassiere with helical underwire that is formed by a length of generally helical coil spring.

There are some certain disadvantages that result from usage of the prior underwires have achieved widespread. In particular, the metal-made underwires are rigid and do not have cushioning tips, and might hurt the user's skin producing substantial discomfort. The present invention provides an improved underwire to improve a user's comfort.

SUMMARY OF THE INVENTION

Accordingly, the main objective is to provide a three-dimension bra cup support structure, utilized to replace the underwire used in conventional bras. Furthermore, the present invention provides an improved bra cup support structure commonly disposed at the lower periphery of a bra cup to facilitate shaping and to support of the breast of a user.

The three-dimension bra support structure comprises at least two fabric layers, at least two nonwoven layers, and at least one foam layer. The fabric layers are adapted as the surface layer and include an inner fabric layer and an outer fabric layer, also, the nonwoven layers are divided into an inner nonwoven layer and an outer nonwoven layer. Besides, the nonwoven layer is sandwiched in between the fabric layer and the foam layer, and the foam layer is sandwiched in the inner and outer nonwoven layers as the central layer, wherein the foam layer includes a chest end and an underarm end. The chest end is thinner than the underarm end, throughout the thermal-pressing, the chest end is getting flexible and the underarm end getting rigid. Thus, the support structure is utilized to close tightly to a user's chest and to centralize the breast effectively.

Furthermore, the support structure, which has a cross-section shaped as a semi-curve, is divided into an upper edge and a lower edge, wherein the lower edge is subsidiary to the lower periphery of the breast and the upper edge is used for supporting. Moreover, the support structure is formed as one-pieced U-shaped structure or one-pieced double U-shaped structure to be fixed at one or both periphery of the bra cup.

BRIEF DESCRIPTION OF THE DRAWINGS

The foregoing aspects, as well as many of the attendant advantages and features of this invention will become more apparent by reference to the following detailed description, when taken in conjunction with the accompanying drawings, wherein.

DESCRIPTION OF THE PREFERRED EMBODIMENT

Figure 1:
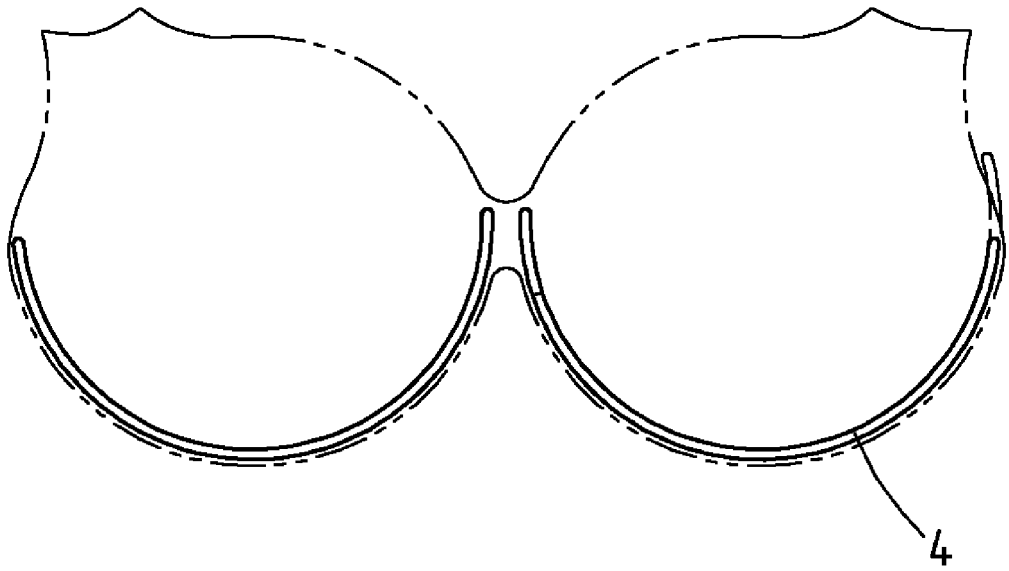
FIG. 1 Prior Art
FIG. 1 is a front view of the bra cup support structure of the prior art.

FIG. 1 illustrates the front view of the conventional bra cup support structure. The elements of bra cup structures known as "underwires" are used for supporting or shaping breasts. The underwires (4) may be made up of a plastic material or a metal wire such as steel, stainless steel, steel wire, or titanium. The underwires (4) are inserted into and held within a fabric sleeve disposed about at least the lower half periphery of the bra cup. However, the underwire (4) is rigid and inflexible, and may pierce the sleeve to cause discomfort and injury, as shown on the right side of FIG. 1.

Figure 2:
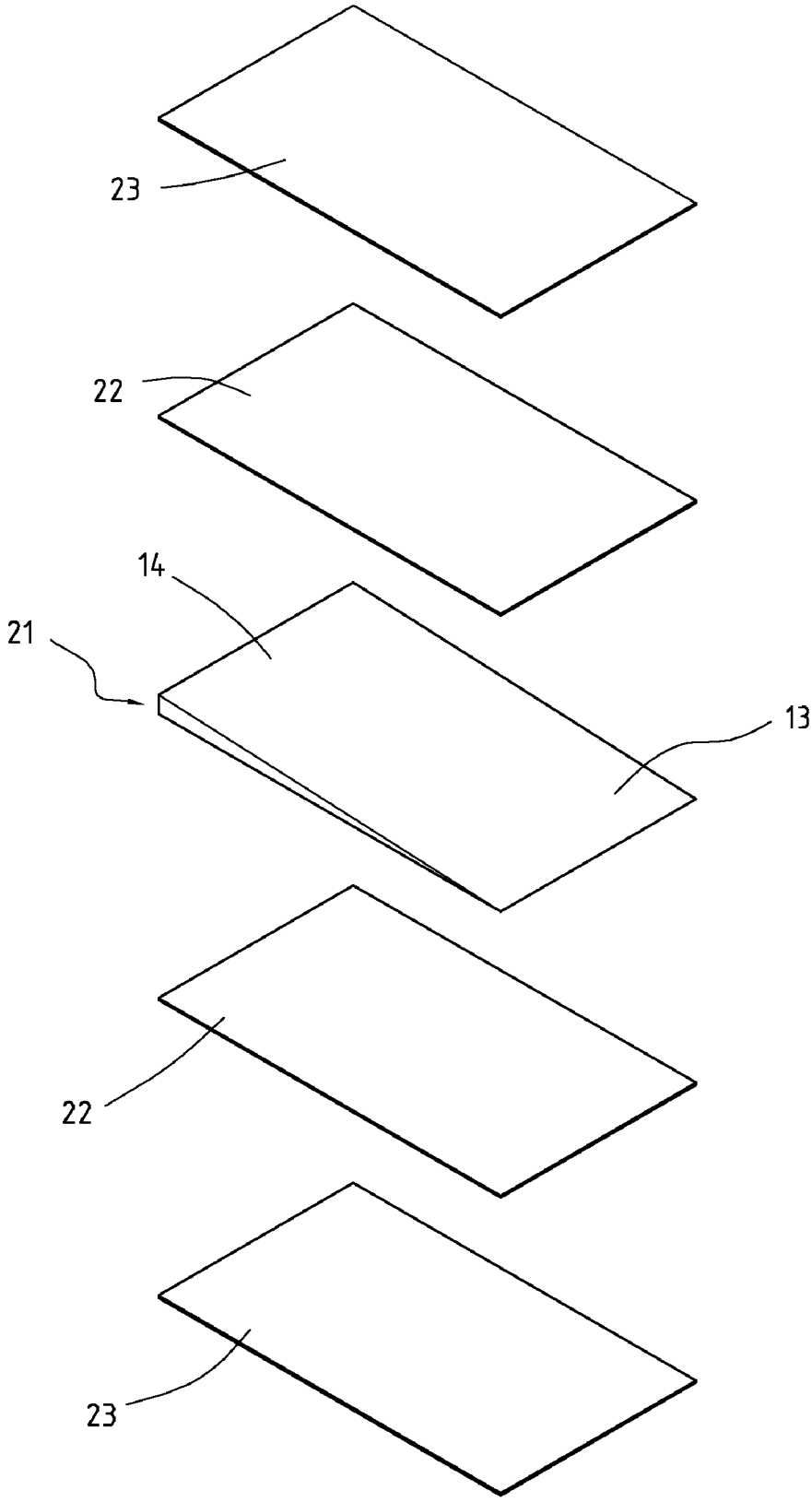
FIG. 2 is an exploded view in accordance with the present invention.
Figure 3:
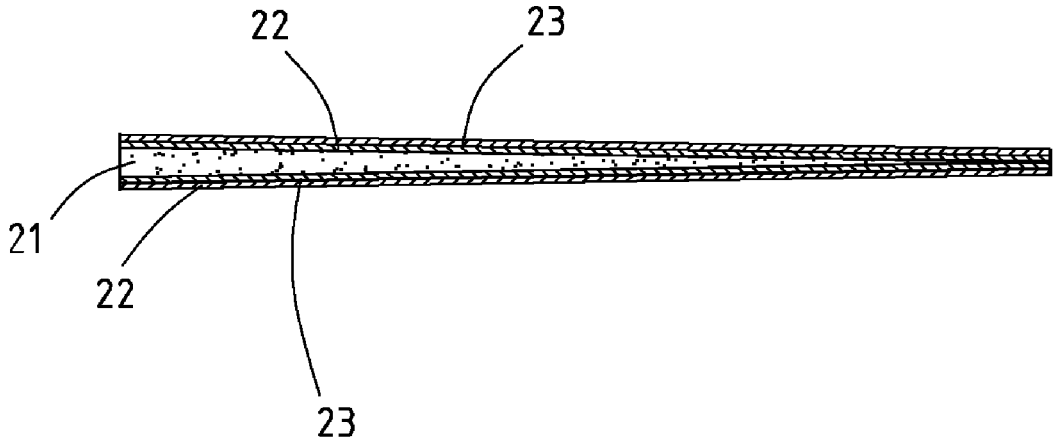
FIG. 3 is an elevation view in accordance with the present invention.
Figure 4:
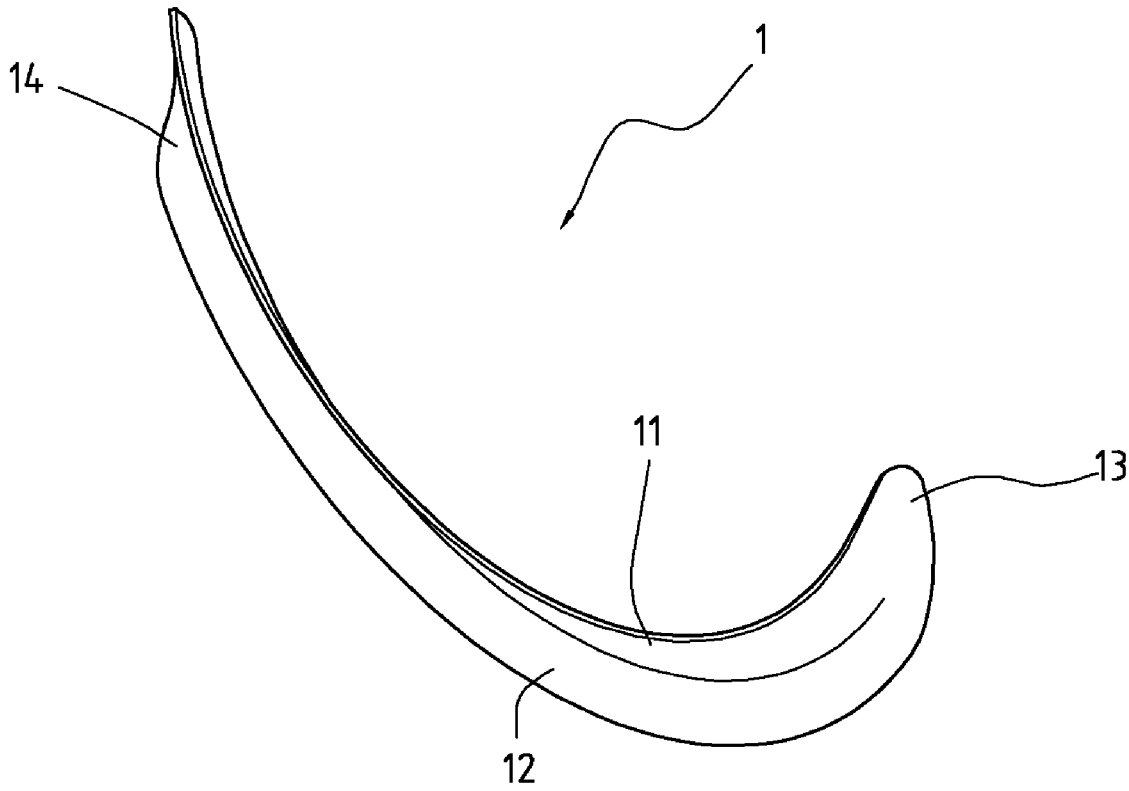
FIG. 4 is a cross-sectional view in accordance with the present invention.

FIGS. 2-4 illustrate the exploded view, elevation view, and cross-sectional view of the bra cup support structure of the present invention. The three-dimension bra cup support structure (1) is composed of fabric, nonwoven and foam material layers, wherein an outer fabric layer (23), an outer nonwoven layer (22), a foam layer (21), an inner nonwoven layer (22) and an inner fabric layer (23) are integrated with gel in sequence and thermal-pressing to constitute the one-piece support structure (1). The support structure (1) is made in an elliptical, oval or U shape. In this preferred embodiment, it is a one-piece U-shape structure installed in the lower periphery of the bra cup.

The support structure (1), which has a cross-section shaped as a semi-curve, is divided into an upper edge (11) and a lower edge (12), wherein the lower edge (12) is subsidiary to the lower periphery of the breast and the upper edge (11) is used for supporting. Furthermore, the foam layer (21) has a chest end (13) and an underarm end (14), wherein the chest end (13) is thinner than the underarm end (14). Consequently, throughout thermal-pressing, the chest end (13) is getting flexible and the underarm end (14) getting rigid. Thus, the support structure is utilized to close tightly to a user's chest and to centralize the breast effectively.

Figure 5:
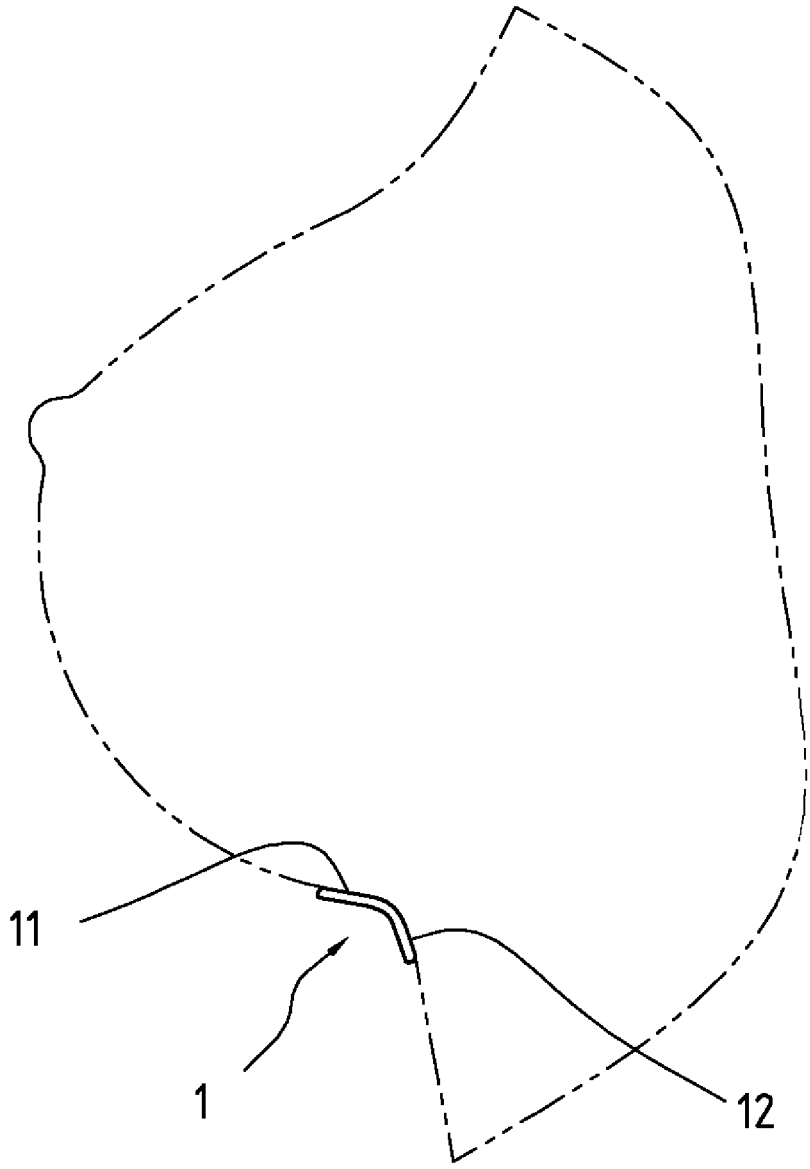
FIG. 5 is a perspective view in accordance with the present invention.

Subsequently, FIG. 5 shows the perspective view in accordance with the present invention. The support structure (1) is installed at the lower periphery of the bra cup and has a cross-section which is shaped as a semi-curve. Besides, the support structure (1) is divided into an upper edge (11) and a lower edge (12). Accordingly, when wearing the bra, the upper edge (11) provides a three dimension support space for supporting the breast, and the lower edge (12) is subsidiary close to the lower periphery of the breast.

Figure 6:
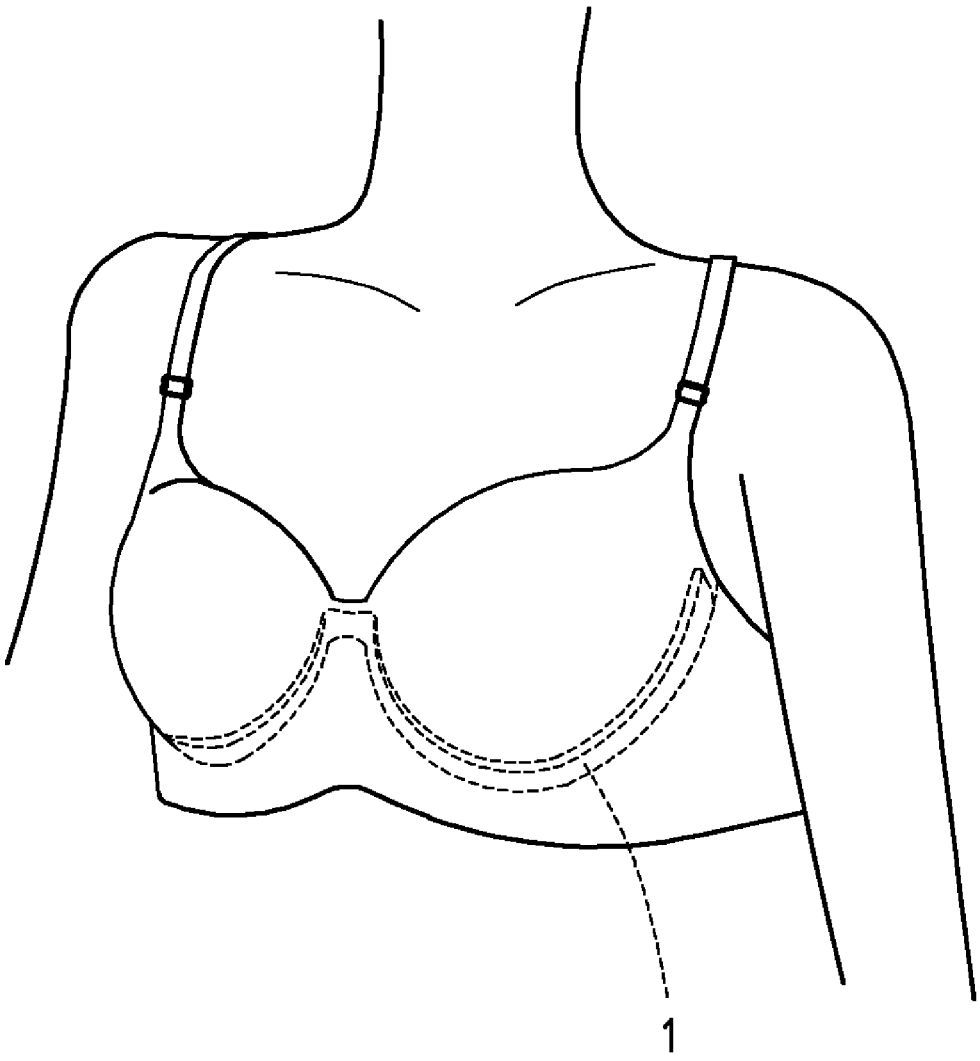
FIG. 6 is an elevation view of the second embodiment of the present invention.

FIG. 6 illustrates the elevation view of the second embodiment of the present invention. In this embodiment, the three-dimension bra cup support structure is one-piece double U-shape support structure (1), which is set at both lower peripheries of the bra cup. The chest end of the foam layer is thinner than the underarm end, thus the chest end is flexible and the underarm end is rigid throughout the thermal-pressing process to make the structure soft and comfortable to wear.

While the invention has been particularly shown and described with reference to the preferred embodiments thereof, these are, of course, merely examples to help clarify the invention and are not intended to limit the invention. It will be understood by those skilled in the art that various changes, modifications, and alterations in form and details may be made therein without departing from the spirit and scope of the invention, as set forth in the following claims.

What is claimed is:

1. A three-dimensional bra cup support structure, comprising:

an inner fabric layer defining an inner surface of the support structure, and an outer fabric layer defining an outer surface of the support structure;

an inner nonwoven layer disposed adjacent to the inner fabric layer, and an outer nonwoven layer disposed adjacent to the outer fabric layer;

at least one foam layer sandwiched between the inner nonwoven layer and the outer nonwoven layer, the foam layer defining a central layer of the support structure, the foam layer having a flexible chest end and a rigid underarm end, the chest end being thinner than the underarm end; and a gel retaining the inner fabric layer, the outer fabric layer, the inner nonwoven layer, the outer nonwoven layer, and the foam layer together to form the support structure as one piece;

the support structure having a semi-curved cross-section divided into an upper edge for supporting a breast, and a lower edge.

2. A three-dimensional bra cup support structure as claimed in claim 1, wherein the inner nonwoven layer is sandwiched between the inner fabric layer and the foam layer, and the outer nonwoven layer is sandwiched between the outer fabric layer and the foam layer.

3. A three-dimensional bra cup support structure as claimed in claim 1, wherein said support structure is U-shaped and fixable at a lower periphery of a bra cup.

4. A three-dimensional bra cup support structure as claimed in claim 1, wherein said support structure is double U-shaped and fixable at respective lower peripheries of two bra cups.

* * * * *